US011040315B2

(12) United States Patent
Nakagawa

(10) Patent No.: US 11,040,315 B2
(45) Date of Patent: Jun. 22, 2021

(54) GAS-DISSOLVED LIQUID PRODUCING APPARATUS

(71) Applicant: EBARA CORPORATION, Tokyo (JP)

(72) Inventor: Yoichi Nakagawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 168 days.

(21) Appl. No.: 16/255,172

(22) Filed: Jan. 23, 2019

(65) Prior Publication Data

US 2019/0262784 A1 Aug. 29, 2019

(30) Foreign Application Priority Data

Feb. 23, 2018 (JP) ..... JP2018-030411

(51) Int. Cl.
*B01F 3/04* (2006.01)
*B01F 13/10* (2006.01)
*B01F 15/00* (2006.01)

(52) U.S. Cl.
CPC ..... *B01F 3/04985* (2013.01); *B01F 3/0446* (2013.01); *B01F 13/1025* (2013.01); *B01F 15/00136* (2013.01); *B01F 15/00344* (2013.01); *B01F 3/04099* (2013.01);
(Continued)

(58) Field of Classification Search
CPC ..... B01F 3/04985; B01F 2003/04886; B01F 13/1025; B01F 3/0446; B01F 15/00344; B01F 5/0473; B01F 2003/04865; B01F 15/00136; B01F 3/04099; B01F 2215/0096; B01F 15/00253; B01F 3/04503; B01F 3/04; B01F 15/00149; B01F 2215/0052
See application file for complete search history.

(56) References Cited

U.S. PATENT DOCUMENTS 5,842,600 A 12/1998 Singleterry et al.
6,464,867 B1 10/2002 Morita et al.
9,150,443 B2 * 10/2015 Hengsperger ..... B01F 5/0415
(Continued)

FOREIGN PATENT DOCUMENTS

JP H11-186207 A 7/1999
JP 2000-308815 A 11/2000
(Continued)

OTHER PUBLICATIONS

Japanese Office Action dated Mar. 30, 2021 issued in Japanese Patent Application No. 2017-247390.

*Primary Examiner* — Stephen Hobson
(74) *Attorney, Agent, or Firm* — Pearne & Gordon LLP

(57) ABSTRACT

A gas-dissolved liquid producing apparatus capable of increasing a gas dissolution efficiency and enhancing stability of the concentration of gas-dissolved liquid is provided.

The gas-dissolved producing apparatus 1 includes an ozone gas supply unit 2 for supplying ozone gas, a pure water supply unit 3 for supplying pure water, and an ozonated water generator 4 for dissolving ozone gas in supplied pure water to generate ozonated water. The generator 4 includes a first nozzle 10 having a first optimum flow rate, a second nozzle 11 having a second optimum flow rate different from the first optimum flow rate, a flow rate detector 15 for detecting the flow rate of the supplied pure water, and a controller 16 for controlling which one of the first nozzle and the second nozzle should be supplied with the supplied gas, based on the flow rate of the pure water detected by the detector 15.

7 Claims, 8 Drawing Sheets

(52) U.S. Cl.
CPC ..... *B01F 2003/04865* (2013.01); *B01F 2003/04886* (2013.01); *B01F 2215/0096* (2013.01)

(56) References Cited

U.S. PATENT DOCUMENTS

| | | | | |
|---|---|---|---|---|
| 9,227,852 | B2 * | 1/2016 | Robinson | B01F 5/0475 |
| 2003/0164338 | A1 * | 9/2003 | Fittkau | G05D 11/132 210/760 |
| 2005/0115909 | A1 | 6/2005 | Haibara et al. | |
| 2010/0147690 | A1 | 6/2010 | Audunson et al. | |
| 2016/0361693 | A1 | 12/2016 | Hayashi | |
| 2017/0164629 | A1 * | 6/2017 | Lynn | B01F 3/0446 |
| 2017/0282132 | A1 * | 10/2017 | Ozawa | C02F 1/78 |
| 2018/0043316 | A1 * | 2/2018 | Anker | C02F 3/20 |
| 2018/0333686 | A1 * | 11/2018 | Nakagawa | B01F 3/04099 |
| 2018/0353911 | A1 * | 12/2018 | Nakagawa | B01F 3/04503 |
| 2019/0015801 | A1 * | 1/2019 | Ozawa | B01F 15/0243 |

FOREIGN PATENT DOCUMENTS

| | | | |
|---|---|---|---|
| JP | 2005-161284 | A | 6/2005 |
| JP | 2007-275744 | A | 10/2007 |
| JP | 2008-006332 | A | 1/2008 |
| JP | 2008-155156 | A | 7/2008 |
| JP | 2010-075838 | A | 4/2010 |
| JP | 2015-155083 | A | 8/2015 |
| JP | 2016-076588 | A | 5/2016 |
| JP | 2018-192439 | A | 12/2018 |
| JP | 2019-155221 | A | 9/2019 |
| KR | 20030012925 | A | 2/2003 |

* cited by examiner

FIG. 7

| | NOZZLE (5L) | NOZZLE (10L) | NOZZLE (20L) |
|---|---|---|---|
| × 0.8 | 4L | 8L | 16L |
| × 1.0 | 5L | 10L | 20L |
| × 1.2 | 6L | 12L | 24L |
| × 1.4 | 7L | 14L | 28L |

GAS-DISSOLVED LIQUID PRODUCING APPARATUS

BACKGROUND OF THE INVENTION

Field of the Invention

The present invention relates to a gas-dissolved liquid producing apparatus for producing gas-dissolved liquid by dissolving gas in liquid.

Description of the Related Art

Cleaning of products in semiconductor device factories and manufacturing factories for electronic parts such as liquid crystals have been recently increasingly improved along with complication of producing processes and miniaturization of circuit patterns. For example, fine particles, metals, organic materials, etc. adhering to silicon wafers are removed by using special liquid (called cleaning liquid) obtained by dissolving high-purity gas, or high-purity gas and chemicals into functional water (for example, ultrapure water or the like).

Ozonated water in which ozone gas is dissolved in pure water is used as the functional water. Ozonated water is generally produced by an ozonated water producing apparatus, but the flow rate of ozonated water to be produced (a required flow rate of ozonated water) varies depending on a use situation at a use point.

A nozzle for dissolving ozone gas in pure water is used in a conventional ozonated water producing apparatus (see Japanese Patent Laid-open No. 2010-75838, for example). In the nozzle, the dissolution efficiency of ozone gas varies according to the flow rate of pure water flowing through the nozzle. In addition, the nozzle includes a region where stability of the concentration of ozonated water deteriorates depending on the concentration of ozone water (the concentration of ozone dissolved in ozonated water) and the flow rate of the ozonated water (see FIG. 6).

However, the conventional ozonated water producing apparatus has the following problem. First, the nozzle has a flow rate (optimum flow rate) that optimizes an ozone dissolution efficiency (an efficiency at which ozone is dissolved in water). Therefore, when the flow rate of pure water supplied to the nozzle deviates from the optimum flow rate, the ozone dissolution efficiency is lowered, and this causes a problem that a larger amount of ozone gas is needed to generate ozonated water having a desired concentration, that is, the use amount of ozone gas increases. Furthermore, when the flow rate of pure water supplied to the nozzle is excessively lower than the optimum flow rate, stability of the concentration of ozonated water generated in the nozzle deteriorates.

The present invention has been made in view of the foregoing problem, and has an object to provide a gas-dissolved liquid producing apparatus capable of increasing a gas dissolution efficiency and also enhancing stability of the concentration of gas-dissolved liquid.

SUMMARY OF THE INVENTION

A gas-dissolved liquid producing apparatus according to the present invention includes: a gas supply unit that supplies gas serving as a raw material of gas-dissolved liquid; a liquid supply unit that supplies liquid serving as a raw material of the gas-dissolved liquid; and a gas-dissolved liquid generator that generates the gas-dissolved liquid by dissolving the gas supplied from the gas supply unit in the liquid supplied from the liquid supply unit, wherein the gas-dissolved liquid generator includes: a first gas dissolving unit having a first optimum flow rate; a second gas dissolving unit having a second optimum flow rate different from the first optimum flow rate; a flow rate detector that detects a flow rate of the liquid supplied from the liquid supply unit; and a controller that controls which one of the first gas dissolving unit and the second gas dissolving unit should be supplied with the gas supplied from the gas supply unit based on the flow rate of the liquid detected by the flow rate detector.

According to this configuration, in the gas dissolving liquid generator, the gas supplied from the gas supply unit is dissolved in the liquid supplied from the liquid supply unit to generate gas-dissolved liquid. The gas-dissolved liquid generator includes the two gas dissolving units (the first gas dissolving unit and the second gas dissolving unit) having different optimum flow rates, and which one of the two gas dissolving units (the first gas dissolving unit and the second gas dissolving unit) should be supplied with the gas supplied from the gas supply unit is controlled based on the flow rate of the liquid supplied from the liquid supply unit. As a result, since gas can be dissolved in an appropriate gas dissolving unit corresponding to the flow rate of the liquid, the gas dissolution efficiency can be increased, and the use amount of gas can be reduced. Furthermore, since gas can be dissolved in an appropriate gas dissolving unit corresponding to the flow rate of the liquid, the stability of the concentration of gas-dissolved liquid generated in the gas-dissolved liquid generator is enhanced.

Furthermore, in the gas-dissolved liquid producing apparatus of the present invention, the first gas dissolving unit and the second gas dissolving unit may be connected in series, and the controller may perform control to supply the first gas dissolving unit with the gas supplied from the gas supply unit when the flow rate detected by the flow rate detector is closer to the optimum flow rate of the first gas dissolving unit than the optimum flow rate of the second gas dissolving unit, and perform control to supply the second gas dissolving unit with the gas supplied from the gas supply unit when the flow rate detected by the flow rate detector is closer to the optimum flow rate of the second gas dissolving unit than the optimum flow rate of the first gas dissolving unit.

According to this configuration, the first gas dissolving unit and the second gas dissolving unit are connected in series, and when the flow rate of liquid supplied to the gas-dissolved liquid generator is close to the optimum flow rate of the first gas dissolving unit (the first optimum flow rate), gas is supplied to the first gas dissolving unit, and dissolution of the gas is performed in the first gas dissolving unit. On the other hand, when the flow rate of liquid supplied to the gas-dissolved liquid generator is close to the optimum flow rate of the second gas dissolving unit (the second optimum flow rate), gas is supplied to the second gas dissolving unit, and dissolution of the gas is performed in the second gas dissolving unit. As described above, dissolution of gas is performed in an appropriate gas dissolving unit corresponding to the flow rate of the liquid.

In the gas-dissolved liquid producing apparatus of the present invention, two arrays each including the first gas dissolving unit and the second gas dissolving unit connected in series may be provided in parallel, the first optimal flow rate may be smaller than the second optimum flow rate, and the first gas dissolving unit may be arranged on an upstream side closer to the liquid supply unit than the second gas dissolving unit.

According to this configuration, the first gas dissolving unit having a smaller optimum flow rate out of the two gas dissolving units (the first gas dissolving unit and the second gas dissolving unit) connected in series is arranged on the upstream side, and the second gas dissolving unit having a larger optimum flow rate is arranged on the downstream side, so that the pressure loss when the gas-dissolved water is generated in the gas-dissolved water generator can be reduced.

In the gas-dissolved liquid producing apparatus of the present invention, the first gas dissolving unit and the second gas dissolving unit may be connected in parallel, and the controller may perform control to supply the first gas dissolving unit with the gas supplied from the gas supply unit and the liquid supplied from the liquid supply unit when the flow rate detected by the flow rate detector is closer to the first optimum flow rate than the second optimum flow rate, and perform control to supply the second gas dissolving unit with the gas supplied from the gas supply unit and the liquid supplied from the liquid supply unit when the flow rate detected by the flow rate detector is closer to the second optimum flow rate than the first optimum flow rate.

According to this configuration, the first gas dissolving unit and the second gas dissolving unit are connected in parallel, and when the flow rate of liquid supplied to the gas-dissolved liquid generator is close to the optimum flow rate of the first gas dissolving unit (first optimum flow rate), gas and liquid are supplied to the first gas dissolving unit, and dissolution of the gas is performed in the first gas dissolving unit. On the other hand, when the flow rate of liquid supplied to the gas-dissolved liquid generator is close to the optimum flow rate of the second gas dissolving unit (the second optimum flow rate), gas and liquid are supplied to the second gas dissolving unit, and dissolution of the gas is performed in the second gas dissolving unit. In this way, it is possible to dissolve gas in an appropriate gas dissolving unit corresponding to the flow rate of liquid.

Furthermore, in the gas-dissolved liquid producing apparatus of the present invention, the gas-dissolved liquid generator may include a third gas dissolving unit that is connected to the first gas dissolving unit and the second gas dissolving unit in parallel, and has a third optimum flow rate different from both of the first optimum flow rate and the second optimum flow rate, and the controller may perform control to supply the first gas dissolving unit and the second gas dissolving unit with the gas supplied from the gas supply unit when the flow rate detected by the flow rate detector is closer to a total flow rate of the first optimum flow rate and the second optimum flow rate than the third optimum flow rate, and perform control to supply the third gas dissolving unit with the gas supplied from the gas supply unit when the flow rate detected by the flow rate detector is closer to the third optimum flow rate than the total flow rate of the first optimum flow rate and the second optimum flow rate.

According to this configuration, the three gas dissolving units (the first gas dissolving unit, the second gas dissolving unit and the third gas dissolving unit) are connected in parallel, and when the flow rate of liquid supplied to the gas-dissolved liquid generator is close to the total flow rate of the optimum flow rate of the first gas dissolving unit and the optimum flow rate of the second gas dissolving unit (the first optimum flow rate+the second optimum flow rate), gas is supplied to the first gas dissolving unit and the second gas dissolving unit, and dissolution of the gas is performed in the first gas dissolving unit and the second gas dissolving unit. On the other hand, when the flow rate of liquid supplied to the gas-dissolved liquid generator is close to the optimum flow rate of the third gas dissolving unit (the third optimum flow rate), gas is supplied to the third gas dissolving unit, and dissolution of the gas is performed in the third gas dissolving unit. In this way, the dissolution of gas can be performed in an appropriate gas dissolving unit(s) corresponding to the flow rate of the liquid.

In the gas-dissolved liquid producing apparatus of the present invention, the controller may perform control to supply the first gas dissolving unit and the second gas dissolving unit with the gas supplied from the gas supply unit when the flow rate detected by the flow rate detector is close to an intermediate value between the total flow rate of the first optimum flow rate and the second optimum flow rate and the third optimum flow rate.

According to this configuration, the three gas dissolving units (the first gas dissolving unit, the second gas dissolving unit, and the third gas dissolving unit) are connected in parallel, and when the flow rate of liquid supplied to the gas-dissolved liquid generator is close to the intermediate value between the total flow rate of the optimum flow rate of the first gas dissolving unit and the optimum flow rate of the second gas dissolving unit (the first optimum flow rate+the second optimum flow rate) and the optimum flow rate of the third gas dissolving unit (the third optimum flow rate), gas is supplied to the first gas dissolving unit and the second gas dissolving unit, and dissolution of the gas is performed in the first gas dissolving unit and the second gas dissolving unit. In this way, since the gas-dissolved water can be generated in the gas dissolving units having small optimum flow rates (the first gas dissolving unit and the second gas dissolving unit), the gas dissolution efficiency when gas-dissolved water is generated can be increased.

In the gas-dissolved liquid producing apparatus of het present invention, the controller may perform control to supply the third gas dissolving unit with the gas supplied from the gas supply unit when the flow rate detected by the flow rate detector is close to the intermediate value between the total flow rate of the first optimum flow rate and the second optimum flow rate and the third optimum flow rate.

According to this configuration, the three gas dissolving units (the first gas dissolving unit, the second gas dissolving unit, and the third gas dissolving unit) are connected in parallel, and when the flow rate of liquid supplied to the gas-dissolved liquid generator is close to the intermediate value between the total flow rate of the optimum flow rate of the first gas dissolving unit and the optimum flow rate of the second gas dissolving unit (the first optimum flow rate+the second optimum flow rate) and the optimum flow rate of the third gas dissolving unit (the third optimum flow rate), gas is supplied to the third gas dissolving unit, and dissolution of the gas is performed in the third gas dissolving unit. In this way, the gas-dissolved water can be generated in the gas dissolving unit having the large optimum flow rate (the third gas dissolving unit), so that the pressure loss when the gas-dissolved water is generated can be reduced.

According to the present invention, the gas dissolution efficiency can be increased, and stability of the concentration of gas-dissolved liquid can be enhanced.

BRIEF DESCRIPTION OF THE DRAWINGS

FIG. 7 is a view showing nozzles to be used in the second embodiment of the present invention.

DETAILED DESCRIPTION OF THE PREFERRED EMBODIMENTS

A gas-dissolved liquid producing apparatus according to an embodiment of the present invention will be described hereinafter with reference to the drawings. In the present embodiment, an ozonated water producing apparatus for producing ozonated water by dissolving ozone gas in pure water will be described as an example.

First Embodiment

Figure 1:
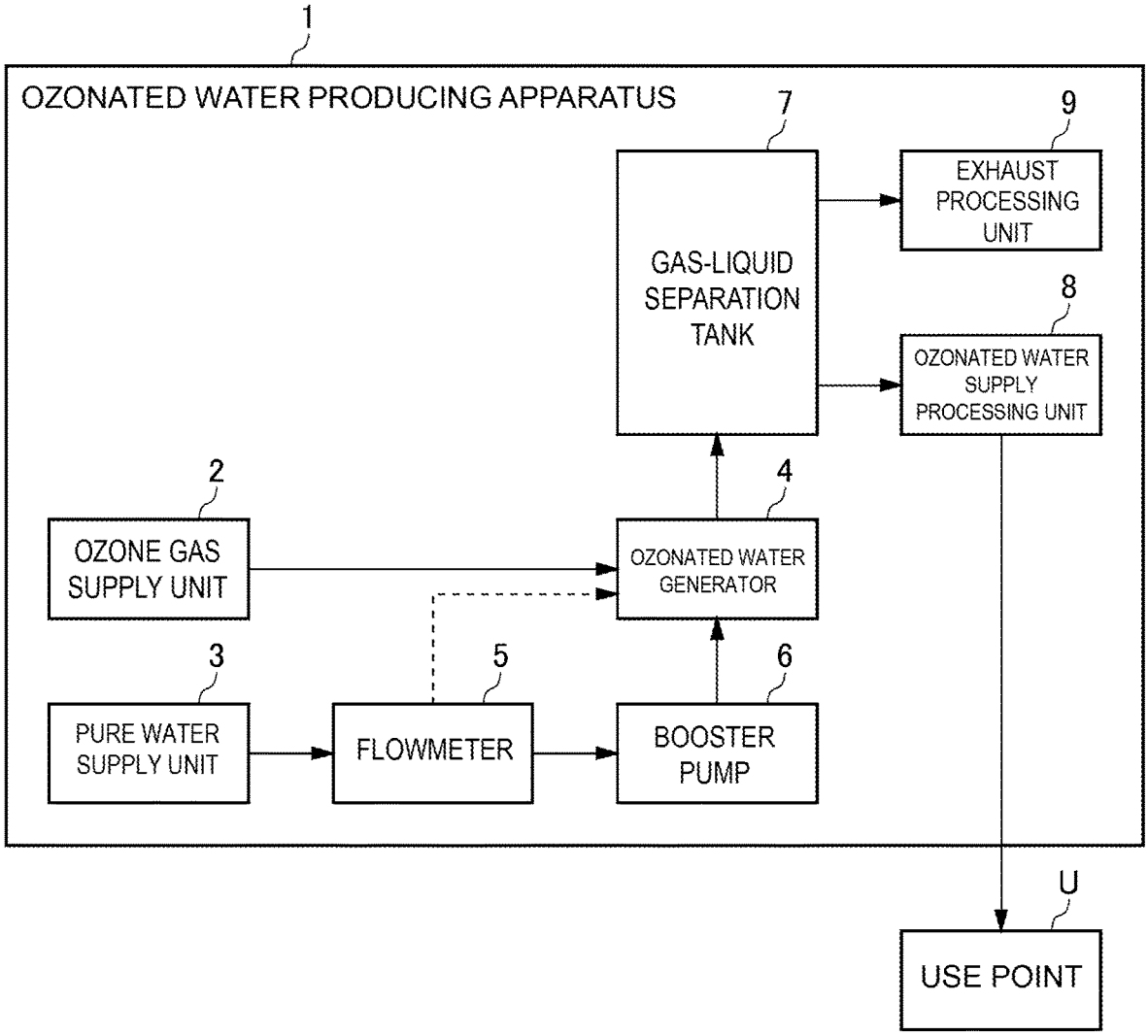
FIG. 1 is a block diagram showing an ozonated water producing apparatus according to a first embodiment of the present invention.

A configuration of an ozonated water producing apparatus according to a first embodiment of the present invention will be described with reference to the drawings. FIG. 1 is a block diagram showing a schematic configuration of the ozonated water producing apparatus of the present embodiment. As shown in FIG. 1, the ozonated water producing apparatus 1 includes an ozone gas supply unit 2 for supplying ozone gas as a raw material of ozonated water, a pure water supply unit 3 for supplying pure water as a raw material of ozonated water, and an ozonated water generator 4 for generating ozonated water by dissolving ozone gas in supplied pure water. Publicly known techniques may be used for supplying ozone gas and pure water as the raw materials.

A flowmeter 5 and a booster pump 6 are provided between the pure water supply unit 3 and the ozonated water generator 4. The flowmeter 5 has a function of measuring the flow rate of pure water supplied from the pure water supply unit 3 (pure water supplied to the ozonated water generator 4), and outputting data representing the measured flow rate (flow rate data) to the ozonated water generator 4. The booster pump 6 has a function of adjusting the flow rate of pure water to be supplied from the pure water supply unit 3 to the ozonated water generator 4.

The ozonated water generated in the ozonated water generator 4 is stored in a gas-liquid separation tank 7. In the gas-liquid separation tank 7, the ozonated water generated in the ozonated water generator 4 is separated into ozonated water to be supplied to a use point and surplus gas to be exhausted from an exhaust port or the like. Supply processing of supplying the ozonated water to the use point is performed by an ozonated water supply processing unit 8. In addition, exhaust processing of exhausting the surplus gas is performed by an exhaust processing unit 9. Publicly known techniques may be used for the supply processing of the ozonated water and the exhausting processing of the surplus gas.

Figure 2:
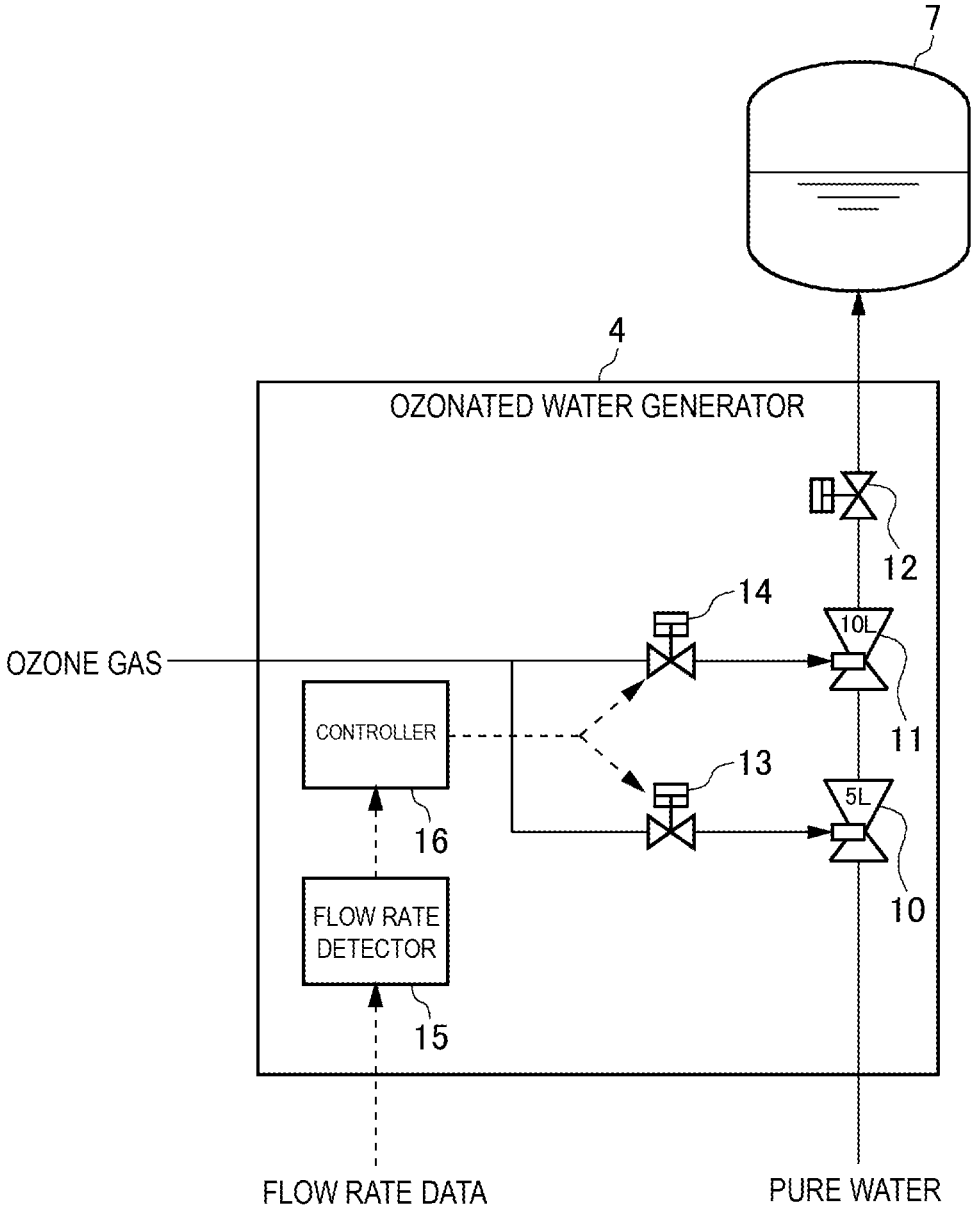
FIG. 2 is an explanatory diagram showing an ozonated water generator in the first embodiment of the present invention.

FIG. 2 is an explanatory diagram of the ozonated water generator 4 of the present embodiment. As shown in FIG. 2, the ozonated water generator 4 includes two nozzles (a first nozzle 10 and a second nozzle 11) connected in series. The nozzle has a function of dissolving gas in liquid supplied thereto. The optimum flow rate of the first nozzle 10 is equal to, for example, 5 L, and the optimum flow rate of the second nozzle 11 is equal to, for example, 10 L. The first nozzle 10 is arranged on an upstream side of the second nozzle 11 (a side closer to the pure water supply unit 3). That is, the pure water supplied to the ozonated water generator 4 is supplied to the first nozzle 10, and then supplied to the second nozzle 11. An output valve 12 is provided on the downstream side of the second nozzle 11.

As shown in FIG. 2, the ozonated water generator 4 is provided with two gas valves (a first gas valve 13 and a second gas valve 14) corresponding to the two nozzles. The ozonated water generator 4 is configured to be capable of supplying ozone gas to any one of the first nozzle 10 and the second nozzle 11 by opening or closing the first gas valve 13 and the second gas valve 14. In the present embodiment, both the first gas valve 13 and the second gas valve 14 are inhibited to be opened at the same time. That is, both the first nozzle 10 and the second nozzle 11 are not supplied with gas at the same time.

Furthermore, as shown in FIG. 2, the ozonated water generator 4 includes a flow rate detector 15 for detecting the flow rate of pure water supplied to the ozonated water generator 4 based on the flow rate data output from the flowmeter 5, and a controller 16 for controlling opening and closing of the two gas valves (the first gas valve 13 and the second gas valve 14) based on the flow rate of pure water detected by the flow rate detector 15. By controlling the opening and closing of the first gas valve 13 and the second gas valve 14, the controller 16 can perform control as to which one of the first nozzle 10 and the second nozzle 11 is supplied with ozone gas supplied from the ozone gas supply unit 2.

For example, when the flow rate detected by the flow rate detector 15 is closer to the optimum flow rate (5 L) of the first nozzle 10 than the optimum flow rate (10 L) of the second nozzle 11 (for example, when the detected flow rate is equal to 6 L), the controller 16 performs control to supply the first nozzle 10 with the ozone gas supplied from the ozone gas supply unit 2. On the other hand, when the flow rate detected by the flow rate detector 15 is closer to the optimum flow rate (10 L) of the second nozzle 11 than the optimum flow rate (5 L) of the first nozzle 10 (for example, when the detected flow rate is equal to 9 L), the controller 16 performs control to supply the second nozzle 11 with the ozone gas supplied from the ozone gas supply unit 2.

According to the ozonated water producing apparatus 1 according to the first embodiment as described above, the ozonated water generator 4 has the two nozzles (the first nozzle 10 and the second nozzle 11) having different optimum flow rates, and it is controlled based on the flow rate of pure water supplied from the pure water supply unit 3 which one of the two nozzles (the first nozzle 10 and the second nozzle 11) should be supplied with the ozone gas supplied from the gas supply unit. As a result, ozone gas can be dissolved in an appropriate nozzle(s) corresponding to the flow rate of pure water, so that the gas dissolution efficiency can be increased and the use amount of ozone gas to obtain a predetermined ozonated water concentration can be reduced. Furthermore, since ozone gas can be dissolved in an appropriate nozzle(s) corresponding to the flow rate of pure water, the stability of the concentration of ozonated water generated in the ozonated water generator 4 is enhanced.

Furthermore, in the present embodiment, the first nozzle 10 and the second nozzle 11 are connected in series, and when the flow rate of pure water supplied to the ozonated water generator 4 is close to the optimum flow rate of the first nozzle 10 (the first optimum flow rate), ozone gas is supplied to the first nozzle 10, and dissolution of ozone gas is performed in the first nozzle 10. On the other hand, when the flow rate of pure water supplied to the ozonated water generator 4 is close to the optimum flow rate of the second nozzle 11 (second optimum flow rate), ozone gas is supplied to the second nozzle 11, and dissolution of ozone gas is performed in the second nozzle 11. In this way, dissolution of ozone gas can be performed in an appropriate nozzle(s) corresponding to the flow rate of pure water.

Modification of First Embodiment

Figure 3:
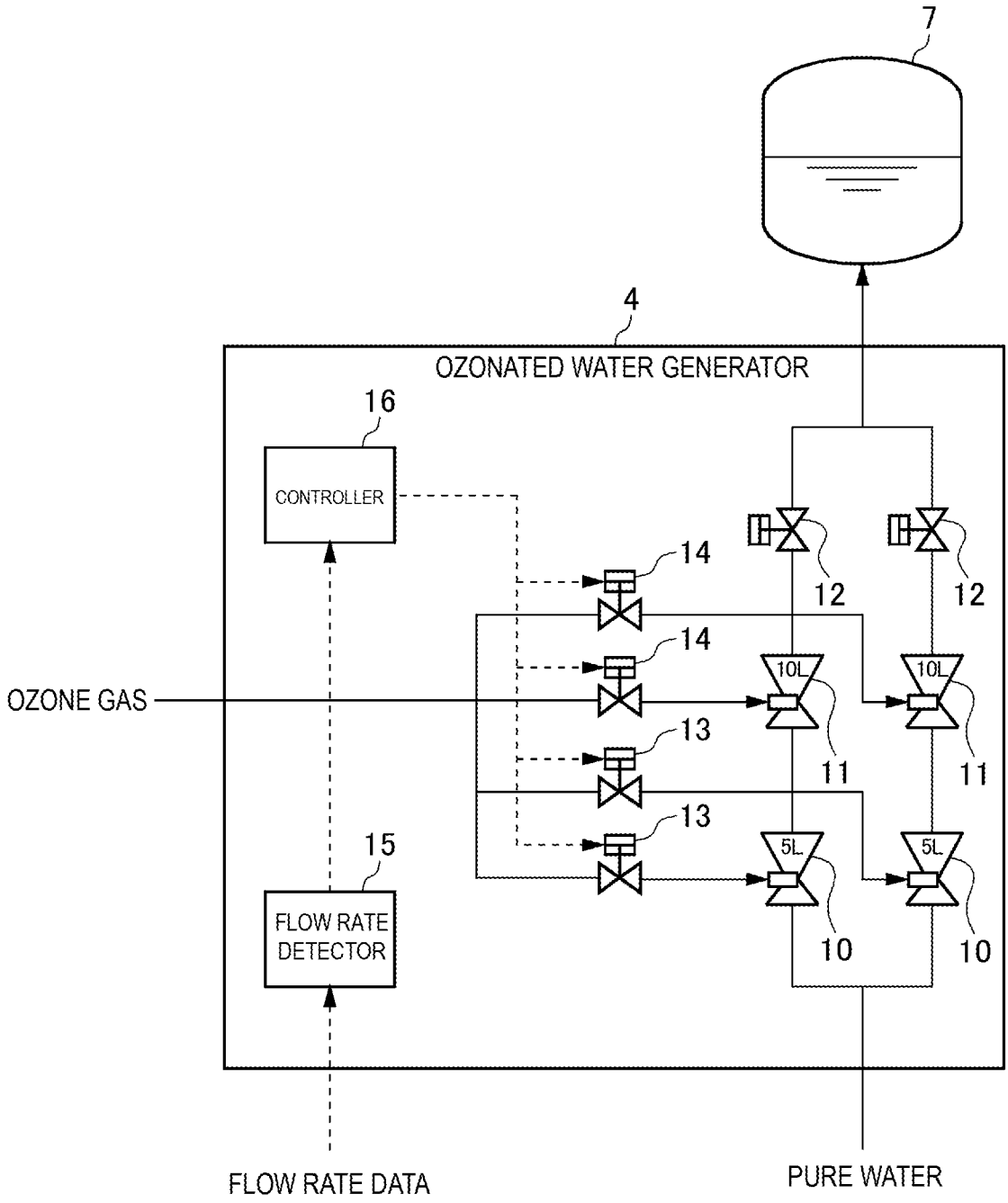
FIG. 3 is an explanatory diagram showing a modification of the ozonated water generator in the first embodiment of the present invention.

FIG. 3 shows a modification of the ozonated water generator 4 according to the first embodiment. As shown in FIG. 3, in this modification, two arrays each including two nozzles (a first nozzle 10 and a second nozzle 11) connected in series are provided in parallel. That is, the ozonated water generator 4 includes two nozzles (the first nozzle 10 and the second nozzle 11) in a first column and two nozzles (the first nozzle 10 and the second nozzle 11) in a second column. In addition, the controller 16 can perform control to supply pure water supplied from the pure water supply unit 3 to any one or both of the nozzle array on the first column and the nozzle array on the second column by switching a switching valve (not shown) provided on the upstream side of the nozzle arrays on the first column and the second column.

In this case, when the flow rate detected by the flow rate detector 15 is larger than the optimum flow rate of the second nozzle 11 (10 L) and also close to the total flow rate of the optimum flow rate of the first nozzle 10 and the optimum flow rate of the second nozzle 11 (15 L=5 L+10 L) (for example, when the detected flow rate is equal to 14 L), the controller 16 performs control to supply the first nozzle 10 on the first column and the second nozzle 11 on the second column with the ozone gas supplied from the ozone gas supply unit 2 and the pure water supplied from the pure water supply unit 3.

Furthermore, when the flow rate detected by the flow rate detector 15 is closer to the total flow rate of the optimum flow rates of the two second nozzles 11 (20 L=10 L+10 L) than the total flow rate of the optimum flow rate of the first nozzle 10 and the optimum flow rate of the second nozzle 11 (15 L=5 L+10 L) (for example, when the detected flow rate is equal to 19 L), the controller 16 performs control to supply the second nozzle 11 on the first column and the second nozzle 11 on the second column with the ozone gas supplied from the ozone gas supply unit 2 and pure water supplied from the pure water supply unit 3.

Accordingly, it is possible to cope with a flow rate larger than the optimum flow rate of the second nozzle 11 (10 L), and dissolve ozone gas in an appropriate nozzle(s) corresponding to the flow rate of pure water.

Furthermore, in the present embodiment, the first nozzle 10 having a smaller optimum flow rate out of the two nozzles (the first nozzle 10 and the second nozzle 11) connected in series is arranged on the upstream side, and the second nozzle 11 having a larger optimum flow rate is arranged on the downstream side, so that it is possible to reduce the pressure loss when the gas-dissolved water is generated in the gas-dissolved water generator.

Figure 4:
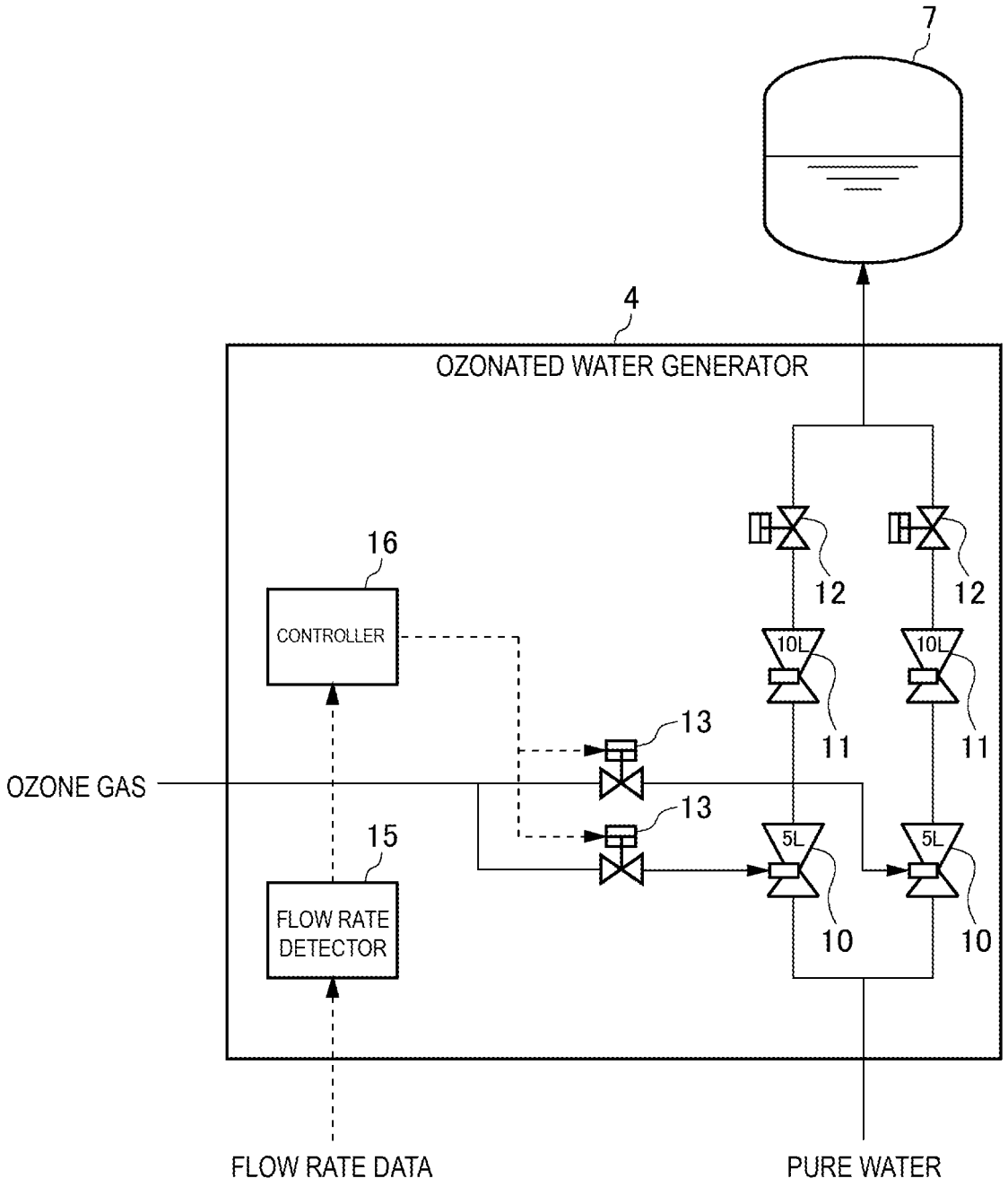
FIG. 4 is an explanatory diagram of another modification of the ozonated water generator in the first embodiment of the present invention.

When the two arrays each including the two nozzles (the first nozzle 10 and the second nozzle 11) connected in series are provided in parallel, only one (for example, the first nozzle 10) of the two nozzles (the first nozzle 10 and the second nozzle 11) may be used as shown in FIG. 4.

Second Embodiment

Next, an ozonated water producing apparatus 1 according to a second embodiment of the present invention will be described. The ozonated water producing apparatus 1 of the second embodiment will be described hereinafter while focusing on differences from the first embodiment. Unless otherwise described hereinafter, the configuration and operation of the present embodiment are the same as the first embodiment.

Figure 5:
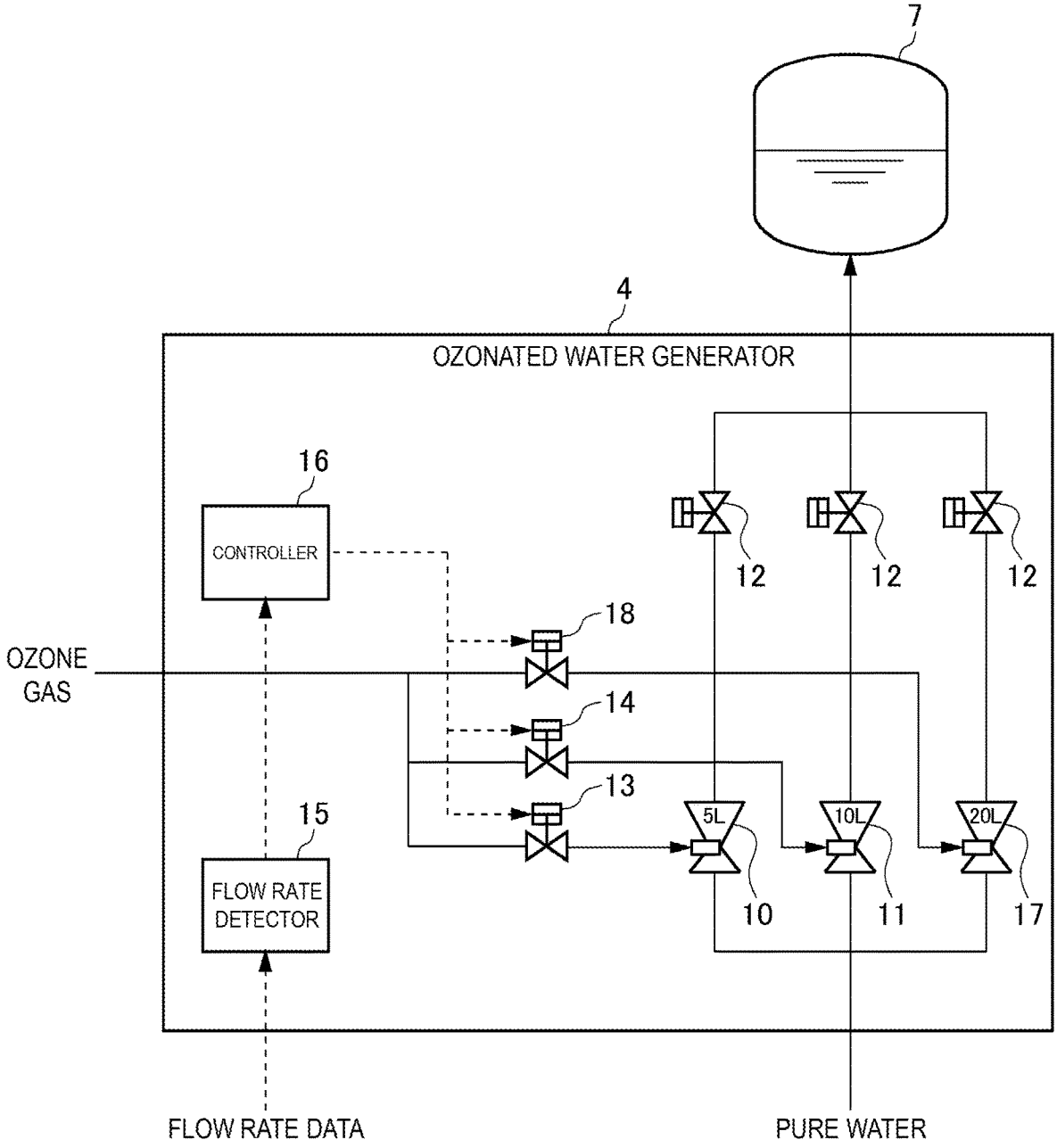
FIG. 5 is an explanatory diagram of an ozonated water generator in a second embodiment of the present invention.

FIG. 5 is an explanatory diagram of an ozonated water generator 4 of the present embodiment. As shown in FIG. 5, the ozonated water generator 4 includes three nozzles (a first nozzle 10, a second nozzle 11, and a third nozzle 17) connected in parallel. The optimum flow rate of the first nozzle 10 is equal to, for example, 5 L, the optimum flow rate of the second nozzle 11 is equal to, for example, 10 L, and the optimum flow rate of the third nozzle 17 is equal to, for example, 20 L. Furthermore, an output valve 12 is provided downstream of each of the three nozzles (the first nozzle 10, the second nozzle 11, and the third nozzle 17).

As shown in FIG. 5, the ozonated water generator 4 is provided with three gas valves (a first gas valve 13, a second gas valve 14, and a third gas valve 18) corresponding to the three nozzles. The ozonated water generator 4 is configured to be capable of supplying ozone gas to each of the first nozzle 10, the second nozzle 13 and the third nozzle 17 independently of one another by opening or closing the first gas valve 13, the second gas valve 14, and the third gas valve 18.

In the present embodiment, any two of the first gas valve 13, the second gas valve 14, and the third gas valve 18 can be opened at the same time, and all of the three valves can be opened at the same time. That is, ozone gas can be supplied to any two of the first nozzle 10, the second nozzle 11, and the third nozzle 17 at the same time, and ozone gas can be supplied to all of the three valves at the same time. It is needless to say that ozone gas can be supplied to any one of the first nozzle 10, the second nozzle 11, and the third nozzle 17 by opening the corresponding one of the first gas valve 13, the second gas valve 14 and the third gas valve 18.

By controlling the opening and closing of the three gas valves (the first gas valve 13, the second gas valve 14, and the third gas valve 18) based on the flow rate of pure water detected by the flow rate detector 15, the controller 16 controls which nozzle(s) of the first nozzle 10, the second nozzle 11, and the third nozzle 17 should be supplied with ozone gas supplied from the ozone gas supply unit 2. In addition, by switching a switching valve (not shown) provided on the upstream side of the three nozzles (the first nozzle 10, the second nozzle 11, and the third nozzle 12), the controller 16 can control which nozzle(s) of the first nozzle 10, the second nozzle 11, and the third nozzle 12 should be supplied with pure water supplied from the pure water supply unit 3.

For example, when the flow rate detected by the flow rate detector 15 is closer to the first optimum flow rate (5 L) than the second optimum flow rate (10 L) (for example, when the detected flow rate is equal to 6 L), the controller 16 performs control to supply the first nozzle 10 with ozone gas supplied from the ozone gas supply unit 2 and pure water supplied from the pure water supply unit 3. Furthermore, when the flow rate detected by the flow rate detector 15 is closer to the second optimum flow rate (10 L) than the first optimum flow rate (5 L) (for example, when the detected flow rate is equal to 9 L), the controller 16 performs control to supply the second nozzle 11 with ozone gas supplied from the ozone gas supply unit 2 and pure water supplied from the pure water supply unit 3. Furthermore, when the flow rate detected by the flow rate detector 15 is closer to the third optimum flow rate (20 L) than the second optimum flow rate (10 L) (for example, when the detected flow rate is equal to 19 L), the controller 16 performs control to supply the third nozzle 17 with ozone gas supplied from the ozone gas supply unit 2 and pure water supplied from the pure water supply unit 3.

When the flow rate detected by the flow rate detector 15 is closer to the total flow rate of the first optimum flow rate and the second optimum flow rate (15 L=5 L+10 L) than the third optimum flow rate (20 L) (for example, when the detected flow rate is equal to 16 L), the controller 16 performs control to supply both the first nozzle 10 and the second nozzle 11 with ozone gas supplied from the ozone gas supply unit 2 and pure water supplied from the pure water supply unit 3. Furthermore, when the flow rate detected by the flow rate detector 15 is closer to the third optimum flow rate (20 L) than the total flow rate of the first optimum flow rate and the second optimum flow rate (15 L=5 L+10 L) (for example, when the detected flow rate is equal to 19 L), the controller 16 performs control to supply the third nozzle 17 with ozone gas supplied from the ozone gas supply unit 2 and pure water supplied from the pure water supply unit 3.

Furthermore, when the flow rate detected by the flow rate detector 15 is close to the intermediate value (17.5 L) between the total flow rate of the first optimum flow rate and the second optimum flow rate and the third optimum flow rate, the controller 16 performs control to supply the first nozzle 10 and the second nozzle 11 with ozone gas supplied from the ozone gas supply unit 2 and pure water supplied from the pure water supply unit 3. Alternatively, when the flow rate detected by the flow rate detector 15 is close to the intermediate value (17.5 L) between the total flow rate of the first optimum flow rate and the second optimum flow rate and the third optimum flow rate, the controller 16 may perform control to supply the third nozzle 17 with ozone gas supplied from the ozone gas supply unit 2 and pure water supplied from the pure water supply unit 3.

The ozonated water producing apparatus 1 according to the second embodiment also achieves the same operation and effect as the first embodiment. That is, the ozonated water generator 4 has the three nozzles (the first nozzle 10, the second nozzle 11, and the third nozzle 17) having the different optimum flow rates, and based on the flow rate of pure water supplied from the pure water supply unit 3, it is controlled which nozzle(s) of the three nozzles (the first nozzle 10, the second nozzle 11, and the third nozzle 17) is supplied with ozone gas supplied from the ozone gas supply unit 2 and pure water supplied from the pure water supply unit 3. As a result, ozone gas can be dissolved in an appropriate nozzle(s) corresponding to the flow rate of pure water, so that the gas dissolution efficiency can be increased and the use amount of ozone gas for obtaining a predetermined ozone water concentration can be reduced. Furthermore, since ozone gas can be dissolved in an appropriate nozzle(s) corresponding to the flow rate of pure water, the stability of the concentration of ozonated water generated in the ozonated water generator 4 is enhanced.

In addition, in the present embodiment, the first nozzle 10, the second nozzle 11, and the third nozzle 17 are connected in parallel, and when the flow rate of pure water supplied to the ozonated water generator 4 is close to the optimum flow rate of the first nozzle 10 (first optimum flow rate), ozone gas is supplied to the first nozzle 10, and dissolution of the ozone gas is performed in the first nozzle 10. Furthermore, when the flow rate of pure water supplied to the ozonated water generator 4 is close to the optimum flow rate of the second nozzle 11 (second optimum flow rate), ozone gas is supplied to the second nozzle 11, and dissolution of the ozone gas is performed in the second nozzle 11. Still furthermore, when the flow rate of pure water supplied to the ozonated water generator 4 is close to the optimum flow rate of the third nozzle 17 (third optimum flow rate), ozone gas is supplied to the third nozzle 17, and dissolution of the ozone gas is performed in the third nozzle 17. In this way, the dissolution of ozone gas is performed in an appropriate nozzle(s) corresponding to the flow rate of pure water.

Figure 6:
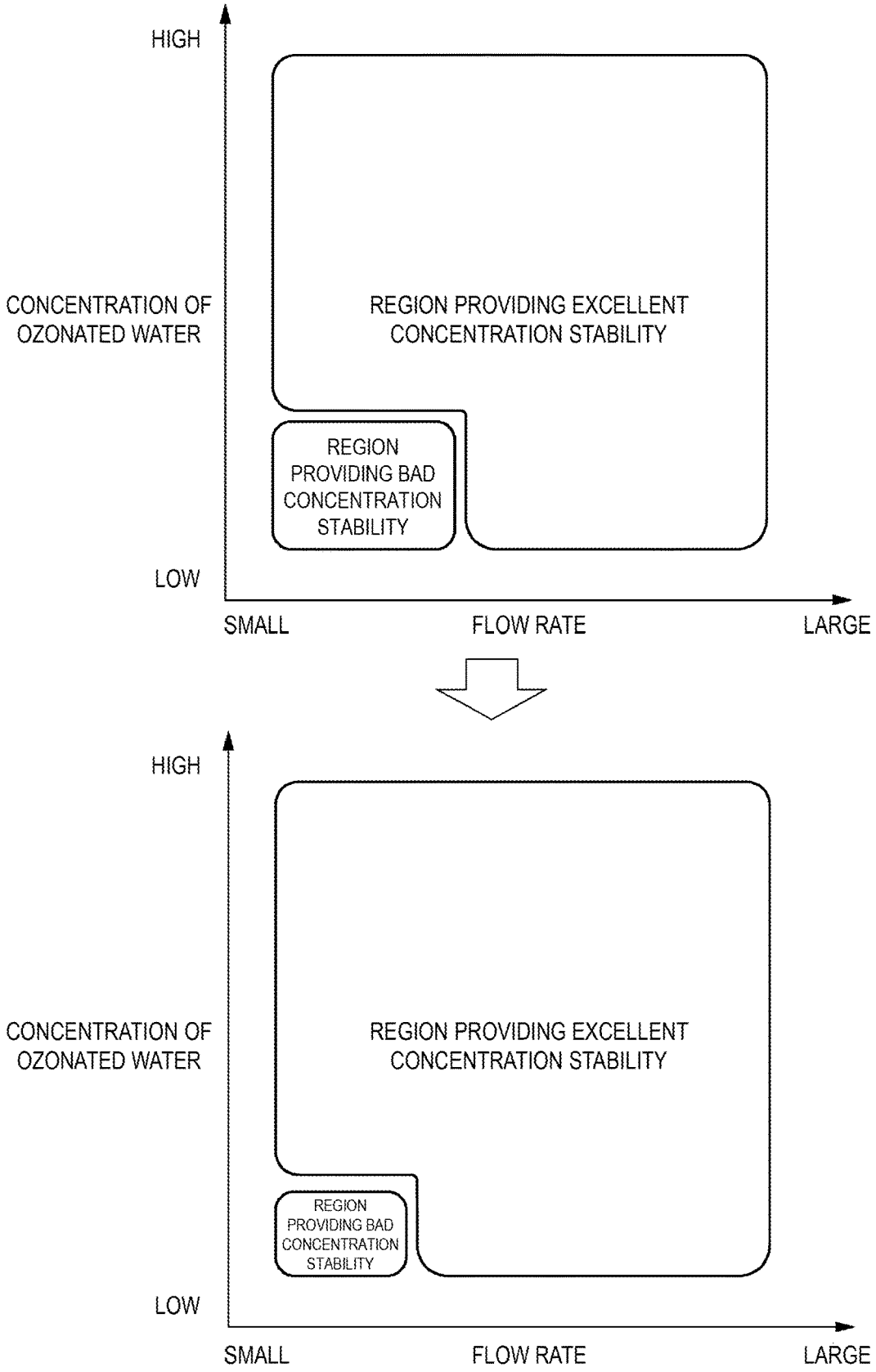
FIG. 6 is a diagram showing concentration stability in the ozonated water generator in the embodiment of the present invention.

In this case, it is possible to select an appropriate nozzle(s) corresponding to the flow rate of pure water supplied to the ozonated water generator 4 from the three nozzles connected in parallel to perform the dissolution of ozone gas, so that when the flow rate of pure water is small, a nozzle having a small optimum flow rate corresponding to the flow rate of pure water can be used. Accordingly, it is possible to avoid use of a nozzle having a large optimum flow rate, so that a region providing excellent concentration stability over the whole system becomes larger as shown in FIG. 6. An upper diagram of FIG. 6 shows the concentration stability of a system in which only a nozzle having a large optimum flow rate is used, and a lower diagram of FIG. 6 shows the concentration stability of the whole system according to the present invention.

Furthermore, which nozzle(s) of the three nozzles connected in parallel should be used may be determined based on a table shown in FIG. 7. A first line (uppermost line) of the table of FIG. 7 shows the optimum flow rates of the nozzles, a first column (leftmost column) of the table of FIG. 7 shows the values of ratios by which the optimum flow rates of the nozzles are multiplied. Numerical values (flow rates) as a result obtained by multiplying the optimum flow rates by the values of the ratios are shown in respective cells from the second line and second column to the fourth line and fourth column of the table of FIG. 7.

In the table of FIG. 7, the optimum flow rates of the nozzles are set so as to constitute a geometric progression (5, 10, 20, etc.), and the values of the ratios are set so as to constitute an arithmetic progression (0.8, 1.0, 1.2, 1.4, etc.).

For example, the table of FIG. 7 shows that the nozzle having the optimum flow rate of 5 L (the first nozzle 10) is used when the flow rate of pure water supplied to the ozonated water generator 4 is equal to "4 L". Likewise, the table of FIG. 7 shows that the nozzle having the optimum flow rate of 20 L (the third nozzle 17) is used when the flow rate of pure water supplied to the ozonated water generator 4 is equal to "28 L". By determining the nozzle to be used corresponding to the flow rate based on such a table, a broad flow rate range (the range from 4 L to 28 L) can be covered in a well-balanced manner.

In the present embodiment, when the flow rate of pure water supplied to the ozonated water generator 4 is close to the total flow rate of the optimum flow rate of the first nozzle 10 and the optimum flow rate of the second nozzle 11 (the first optimum flow rate+the second optimum flow rate), ozone gas is supplied to the first nozzle 10 and the second nozzle 11, and dissolution of the ozone gas is performed in the first nozzle 10 and the second nozzle 11. On the other hand, when the flow rate of pure water supplied to the ozonated water generator 4 is close to the optimum flow rate of the third nozzle 17 (the third optimum flow rate), ozone gas is supplied to the third nozzle 17, and dissolution of the ozone gas is performed in the third nozzle 17. In this way, the dissolution of ozone gas can be performed in an appropriate nozzle(s) corresponding to the flow rate of pure water.

Furthermore, in the present embodiment, when the flow rate of pure water supplied to the ozonated water generator 4 is close to the intermediate value between the total flow rate of the optimum flow rate of the first nozzle 10 and the optimum flow rate of the second nozzle 11 (the first optimum flow rate+the second optimum flow rate) and the optimum flow rate of the third nozzle 17 (the third optimum flow rate), ozone gas is supplied to the first nozzle 10 and the second nozzle 11, and dissolution of the ozone gas is performed in the first nozzle 10 and the second nozzle 11. In this way, since gas-dissolved water can be generated with the nozzles having small optimum flow rates (the first nozzle 10 and the second nozzle 11), the gas dissolution efficiency when the gas-dissolved water is generated can be increased.

Alternatively, when the flow rate of pure water supplied to the ozonated water generator 4 is close to the intermediate value between the total flow rate of the optimum flow rate of the first nozzle 10 and the optimum flow rate of the second nozzle 11 (the first optimum flow rate+the second optimum flow rate) and the optimum flow rate of the third nozzle 17 (the third optimum flow rate), ozone gas is supplied to the third nozzle 17, and dissolution of the ozone gas is performed in the third nozzle 17. In this way, since gas-dissolved water can be generated with the nozzle having a large optimum flow rate (the third nozzle 17), the pressure loss when gas-dissolved water is generated can be reduced.

Modification of Second Embodiment

Figure 8:
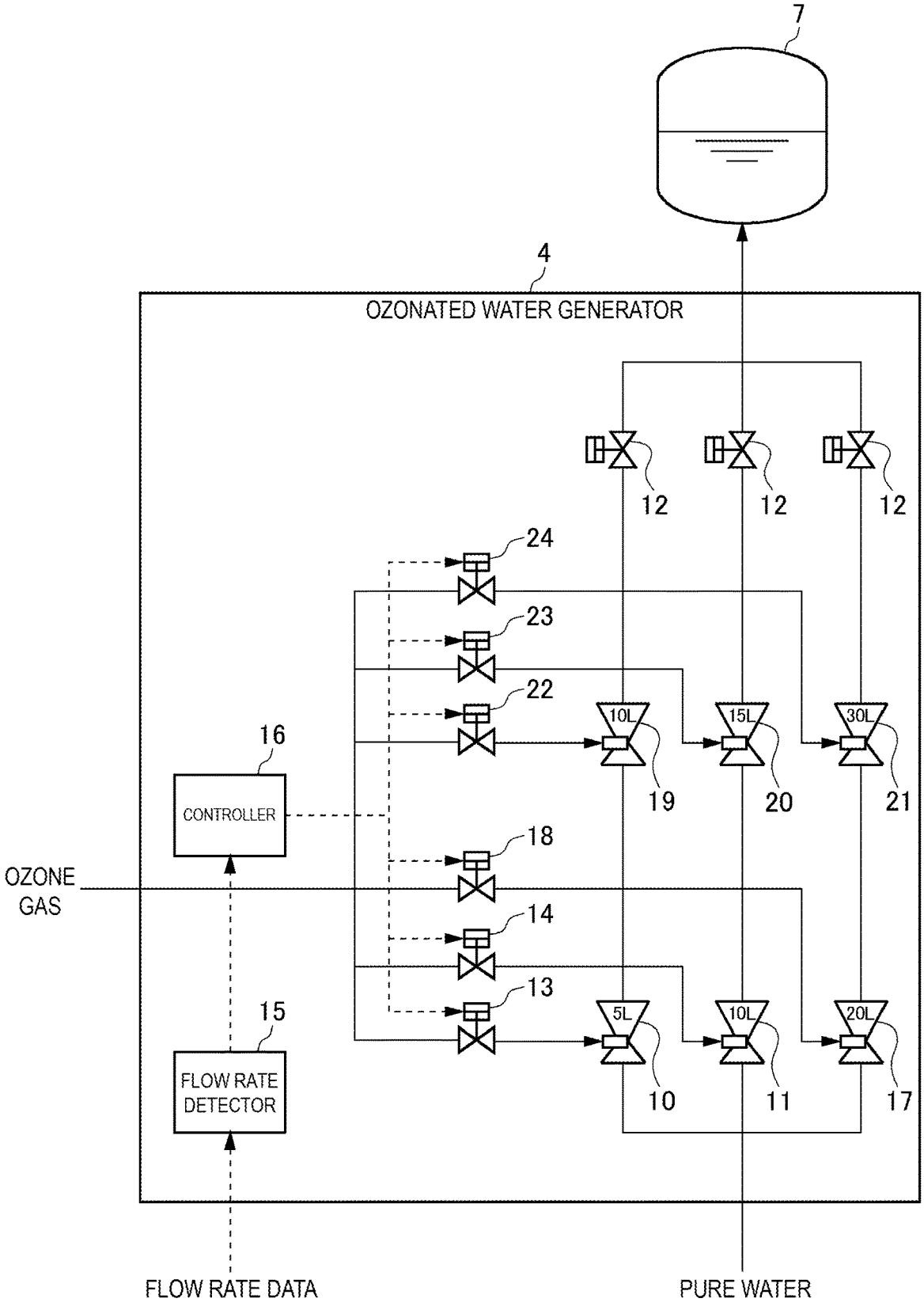
FIG. 8 is an explanatory diagram showing a modification of the ozonated water generator in the second embodiment of the present invention.

FIG. 8 shows a modification of the ozonated water generator 4 of the second embodiment. In the present modification, three nozzles (a fourth nozzle 19, a fifth nozzle 20, and a sixth nozzle 21) connected in series are provided on the rear stage of three nozzles (a first nozzle 10, a second nozzle 11, and a third nozzle 17) connected in parallel as shown in FIG. 8. The optimum flow rate of the first nozzle 10 is equal to, for example, 5 L, the optimum flow rate of the second nozzle 11 is equal to, for example, 10 L, and the optimum flow rate of the third nozzle 17 is equal to, for example, 20 L. Furthermore, the optimum flow rate of the fourth nozzle 19 is equal to, for example, 10 L, the optimum flow rate of the fifth nozzle 20 is equal to, for example, 15 L, and the optimum flow rate of the sixth nozzle 21 is equal to, for example, 30 L.

As shown in FIG. 8, the ozonated water generator 4 includes six gas valves (a first gas valve 13, a second gas valve 14, a third gas valve 18, a fourth gas valve 22, a fifth gas valve 23, and a sixth gas valve 24) corresponding to the six nozzles. The ozonated water generator 4 is configured to be capable of supplying ozone gas to the six nozzles (the first nozzle 10 to the sixth nozzle 21) independently of one another by opening or closing the six gas valves (the first gas valve 13 to the sixth gas valve 24).

Therefore, it is possible to select an appropriate nozzle(s) corresponding to the flow rate of pure water supplied to the ozonated water generator 4 from the six nozzles (the first nozzle 10 to the sixth nozzle 21) to perform dissolution of ozone gas, so that a broader flow rate range can be covered in a well-balanced manner.

The embodiments of the present invention have been described by way of examples. However, the scope of the present invention is not limited to these embodiments, and the embodiment can be altered and modified according to the purpose within the scope described in the claims.

For example, the foregoing description has been made by exemplifying the ozonated water producing apparatus for producing ozonated water by dissolving ozone gas in pure water, but the scope of the present invention is not limited to this ozonated water producing apparatus. That is, the gas as a raw material is not limited to ozone gas, and the liquid as a raw material is not limited to pure water. For example, carbonated water may be produced by dissolving carbon dioxide in pure water or nitrogen water may be produced by dissolving nitrogen in pure water. Furthermore, hydrogen water may be produced by dissolving hydrogen in pure water. The present invention can be also applied to dissolution of gas for producing functional water.

As described above, the gas-dissolved liquid producing apparatus according to the present invention has an effect of increasing the gas dissolution efficiency and enhancing the stability of the concentration of gas-dissolved liquid, and is useful, for example, as an ozonated water producing apparatus for producing ozonated water by dissolving ozone gas in pure water, etc.

DESCRIPTION OF REFERENCE SIGNS

1 Ozonated water producing apparatus (gas-dissolved liquid producing apparatus)
2 Ozone gas supply unit (gas supply unit)
3 Pure water supply unit (liquid supply unit)
4 Ozonated water generator (gas-dissolved liquid generator)
5 Flowmeter
6 Booster pump
7 Gas-liquid separation tank
8 Ozonated water supply processing unit
9 Exhaust processing unit
10 First nozzle (first gas dissolving unit)
11 Second nozzle (second gas dissolving unit)
12 Output valve
13 First gas valve
14 Second gas valve
15 Flow rate detector
16 Controller
17 Third nozzle (third gas dissolving unit)
18 Third gas valve
19 Fourth nozzle
20 Fifth nozzle
21 Sixth nozzle
22 Fourth gas valve
23 Fifth gas valve
24 Sixth gas valve
U Use point

What is claimed is:

1. A gas-dissolved liquid producing apparatus comprising:

a gas supply unit that supplies gas serving as a raw material of gas-dissolved liquid;

a liquid supply unit that supplies liquid serving as a raw material of the gas-dissolved liquid; and a gas-dissolved liquid generator that generates the gas-dissolved liquid by dissolving the gas supplied from the gas supply unit in the liquid supplied from the liquid supply unit, wherein the gas-dissolved liquid generator includes:

a first gas dissolving unit having a first optimum flow rate;

a second gas dissolving unit having a second optimum flow rate different from the first optimum flow rate;

a flow rate detector that detects a flow rate of the liquid supplied from the liquid supply unit; and a controller that controls which one of the first gas dissolving unit and the second gas dissolving unit should be supplied with the gas supplied from the gas supply unit based on the flow rate of the liquid detected by the flow rate detector.

2. The gas-dissolved liquid producing apparatus according to claim 1, wherein the first gas dissolving unit and the second gas dissolving unit are connected in series, and the controller performs control to supply the first gas dissolving unit with the gas supplied from the gas supply unit when the flow rate detected by the flow rate detector is closer to the optimum flow rate of the first gas dissolving unit than the optimum flow rate of the second gas dissolving unit, and performs control to supply the second gas dissolving unit with the gas supplied from the gas supply unit when the flow rate detected by the flow rate detector is closer to the optimum flow rate of the second gas dissolving unit than the optimum flow rate of the first gas dissolving unit.

3. The gas-dissolved liquid producing apparatus according to claim 2, wherein two arrays each including the first gas dissolving unit and the second gas dissolving unit connected in series are provided in parallel, wherein in each array:

the first optimal flow rate is smaller than the second optimum flow rate, and the first gas dissolving unit is arranged on an upstream side closer to the liquid supply unit than the second gas dissolving unit.

4. The gas-dissolved liquid producing apparatus according to claim 1, wherein the first gas dissolving unit and the second gas dissolving unit are connected in parallel, and the controller performs control to supply the first gas dissolving unit with the gas supplied from the gas supply unit and the liquid supplied from the liquid supply unit when the flow rate detected by the flow rate detector is closer to the first optimum flow rate than the second optimum flow rate, and performs control to supply the second gas dissolving unit with the gas supplied from the gas supply unit and the liquid supplied from the liquid supply unit when the flow rate detected by the flow rate detector is closer to the second optimum flow rate than the first optimum flow rate.

5. The gas-dissolved liquid producing apparatus according to claim 4, wherein the gas-dissolved liquid generator includes a third gas dissolving unit that is connected to the first gas dissolving unit and the second gas dissolving unit in parallel, and has a third optimum flow rate different from both of the first optimum flow rate and the second optimum flow rate, and the controller performs control to supply the first gas dissolving unit and the second gas dissolving unit with the gas supplied from the gas supply unit when the flow rate detected by the flow rate detector is closer to a total flow rate of the first optimum flow rate and the second optimum flow rate than the third optimum flow rate, and performs control to supply the third gas dissolving unit with the gas supplied from the gas supply unit when the flow rate detected by the flow rate detector is closer to the third optimum flow rate than the total flow rate of the first optimum flow rate and the second optimum flow rate.

6. The gas-dissolved liquid producing apparatus according to claim 5, wherein the controller performs control to supply the first gas dissolving unit and the second gas dissolving unit with the gas supplied from the gas supply unit when the flow rate detected by the flow rate detector is close to an intermediate value between the total flow rate of the first optimum flow rate and the second optimum flow rate and the third optimum flow rate.

7. The gas-dissolved liquid producing apparatus according to claim 5, wherein the controller performs control to supply the third gas dissolving unit with the gas supplied from the gas supply unit when the flow rate detected by the flow rate detector is close to an intermediate value between the total flow rate of the first optimum flow rate and the second optimum flow rate and the third optimum flow rate.

* * * * *